US010960242B2

(12) United States Patent
Wang et al.

(10) Patent No.: US 10,960,242 B2
(45) Date of Patent: Mar. 30, 2021

(54) FALL PROTECTION DEVICE

(71) Applicant: YOKE INDUSTRIAL CORP., Taichung (TW)

(72) Inventors: Jyu-Yi Wang, Changhua (TW); Wen-Ming Liao, Taichung (TW); Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 74 days.

(21) Appl. No.: 16/194,008

(22) Filed: Nov. 16, 2018

(65) Prior Publication Data

US 2020/0078619 A1 Mar. 12, 2020

(30) Foreign Application Priority Data

Sep. 11, 2018 (TW) ..... 107131917

(51) Int. Cl.
*A62B 35/00* (2006.01)

(52) U.S. Cl.
CPC ..... *A62B 35/0093* (2013.01)

(58) Field of Classification Search
CPC ..... A62B 1/08; A62B 1/10; A62B 35/0093; F16D 59/00
See application file for complete search history.

(56) References Cited

U.S. PATENT DOCUMENTS 7,780,146 B2 * 8/2010 Casebolt ..... A62B 1/10 254/346
8,181,744 B2 * 5/2012 Parker ..... A62B 1/10 182/232
8,490,750 B2 * 7/2013 Balquist ..... A62B 35/0093 182/231
9,121,462 B2 * 9/2015 Casebolt ..... A62B 1/10
9,199,103 B2 * 12/2015 Hetrich ..... A62B 1/10
(Continued)

FOREIGN PATENT DOCUMENTS

TW M550643 U 10/2017
TW 201739484 A 11/2017
TW M572767 U 1/2019

OTHER PUBLICATIONS

English abstract for TW201739484, Total of 1 page.
(Continued)

*Primary Examiner* — Colleen M Chavchavadze
(74) *Attorney, Agent, or Firm* — Tracy M. Heims; Apex Juris, Pllc.

(57) ABSTRACT

A fall protection device includes a frame, a rotatable member, a safety belt, a braking plate, and at least one braking part, wherein a side surface of the frame has at least one stopper protruding therefrom. A stopper integrally protrudes from two adjacent side walls of a hole as a monolithic unit and extends in an arc shape. The rotatable member is rotatably and pivotally disposed on the frame. The safety belt winds around the rotatable member. The braking plate is coaxially connected to the rotatable member, whereby the braking plate rotates coaxially along with the rotatable member. The braking part is pivotally connected to an inner surface of the braking plate. When the braking plate rotates, the braking part is driven to pivot from a restoring position to a locking position to abut against the stopper, thereby to restrict the rotatable member from rotating.

12 Claims, 6 Drawing Sheets

(56) References Cited

U.S. PATENT DOCUMENTS

| | | | | |
|---|---|---|---|---|
| 9,861,841 | B1 * | 1/2018 | Hung | A62B 35/0093 |
| 10,391,339 | B2 * | 8/2019 | Sun | A62B 35/0093 |
| 10,478,646 | B2 * | 11/2019 | Sun | A62B 35/0093 |
| 2013/0105247 | A1 * | 5/2013 | Casebolt | A62B 1/10 182/241 |
| 2018/0289987 | A1 * | 10/2018 | Hung | A62B 1/14 |
| 2018/0333598 | A1 * | 11/2018 | Hung | A62B 35/0075 |
| 2019/0030381 | A1 * | 1/2019 | Hung | A62B 35/0037 |

OTHER PUBLICATIONS

English abstract for TWM550643, Total of 1 page.
English abstract for TWM572767, Total of 1 page.
English Translation of Taiwan Search Report for corresponding Application No. 10713191.
English translation of examination report for TW107131917, dated Mar. 13, 2020, Total pages of 5.

* cited by examiner

FALL PROTECTION DEVICE

BACKGROUND OF THE INVENTION

Technical Field

The present invention relates generally to a fall protection device, and more particularly to a fall protection device suitable for a hanging work site.

Description of Related Art

Fall protection devices are usually used in a person working in elevated workplaces to provide a braking effect when the person falls, preventing the person from continuing fall and ensuring the safety of the person.

A conventional fall protection device is mainly composed of a fixed body, a rotating body rotatably disposed on the fixed body, a belt body connected to the rotating body, a plurality of braking parts pivotally disposed on the rotating body, and a plurality of stoppers connected to the fixed body. While using the conventional fall protection device, the fixed body is adapted to be connected to an external support, and the belt body is adapted to be fastened on the person working in elevated workplaces. When the person carelessly falls from an elevated site, the belt body will be pulled by the person to rotate the rotating body rapidly, so that the braking parts are spun out to bump and abut against the stoppers by a centrifugal force. With the blocking of the stoppers, the rotating body cannot rotate, thereby preventing the belt body being continuously pulled out and preventing the person from continuously falling.

However, in the conventional fall protection device, a cross-section of a joint between each of the stoppers and the fixed body is rectangular, so that when the stoppers are bumped by the braking parts, the stress is easily concentrated, and the joint between each of the stoppers and the fixed body is easy to crack or fracture. As a result, a withstanding force of the conventional fall protection device may thus reduce, or even worst, the stoppers will break from the crack and lose the locking effect, which cannot ensure the safety of the person.

BRIEF SUMMARY OF THE INVENTION

In view of the above, the primary objective of the present invention is to provide a fall protection device, which could distribute a bearing force while locking, reducing the damage of the components.

In addition, the another primary objective of the present invention is to provide a fall protection device, which could extend a service life.

The present invention provides a fall protection device, which includes a frame, a rotatable member, a safety belt, a braking plate, and at least one braking part, wherein a side surface of the frame has at least one stopper protruding therefrom. The at least one stopper has a first side end and a second side end, and extends in an arc shape from the first side end toward the second side end. The rotatable member is rotatably and pivotally disposed on the frame. The safety belt winds around an outer peripheral surface of the rotatable member and pulls the rotatable member to rotate. The braking plate is coaxially connected to the rotatable member, whereby the braking plate rotates coaxially along with the rotatable member. The at least one braking part is pivotally connected to the braking plate and faces the side surface of the frame, wherein when the braking plate rotates, the at least one braking part is driven to pivot from a restoring position to a locking position to abut against the first side end of the at least one stopper, thereby to restrict the rotatable member from rotating.

With the stopper which extends in an arc shape, when the stopper is bumped and is abutted by the braking part, the stress could be distributed, whereby stress could be prevented from excessive concentration and retention. In addition, the engaging strength between the stopper and the frame could be strengthened, thereby the components could be prevented from damage, increasing the service life of the fall protection device.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
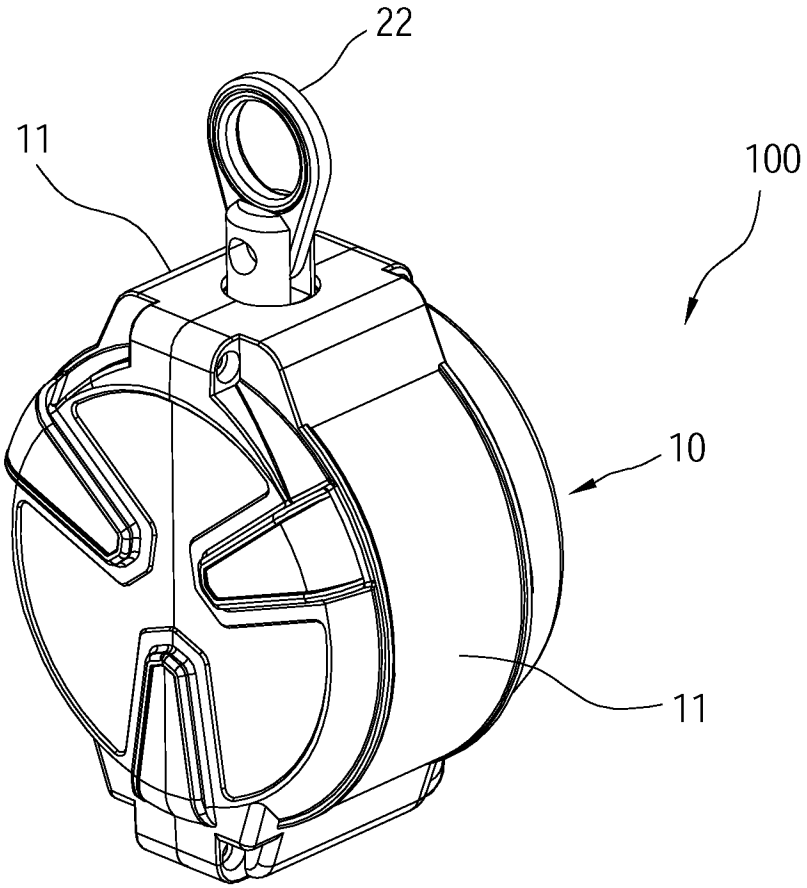
FIG. 1 is a perspective view of the fall protection device of an embodiment according to the present invention.

A fall protection device 100 is illustrated in FIG. 1 to FIG. 5 and includes a housing 10, a frame 20, a rotatable member 30, a safety belt 40, a winding device 50, a braking plate 60, at least one braking part 70, and at least one restoring spring 80.

Figure 2A:
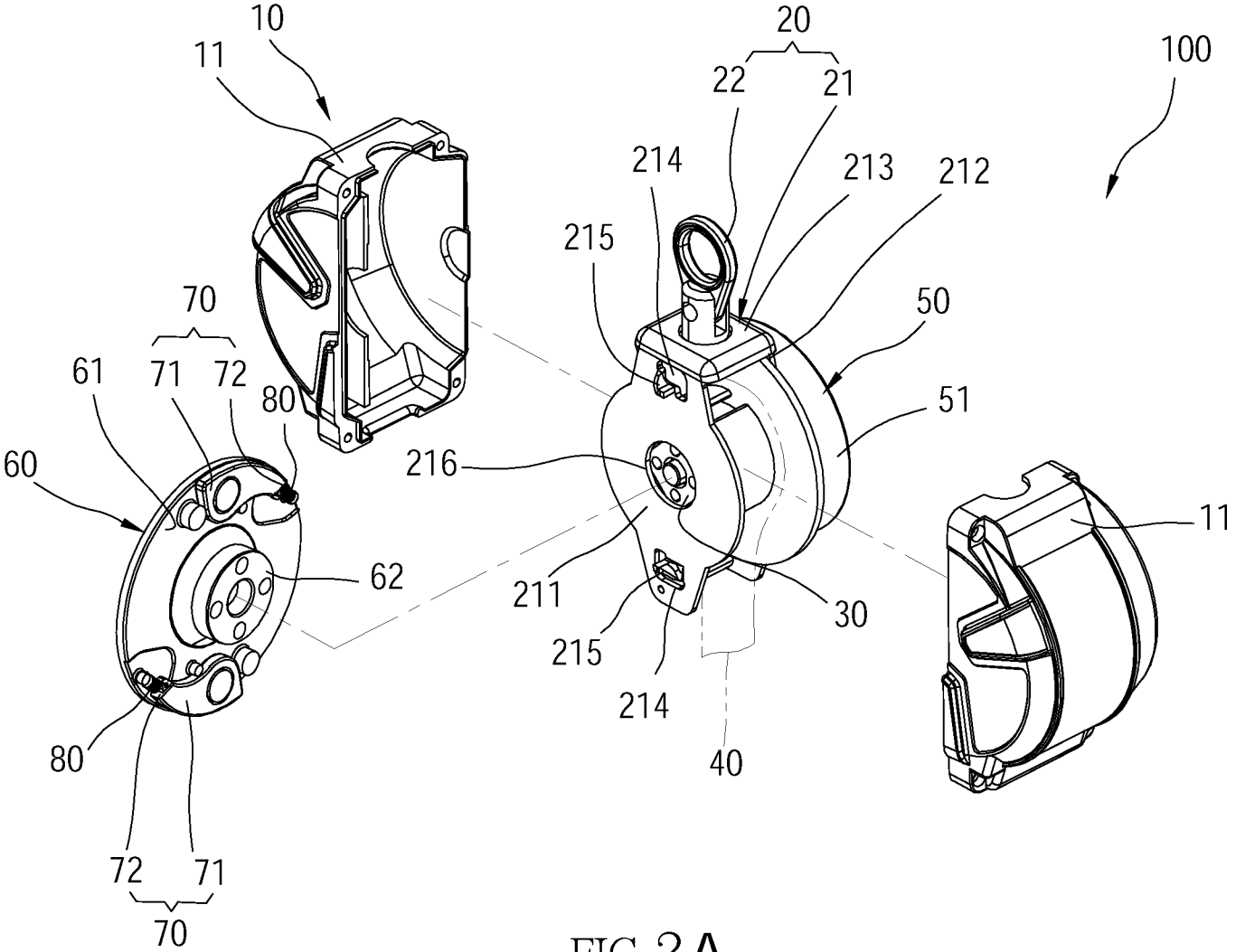
FIG. 2A is an exploded perspective view of FIG. 1.
Figure 2B:
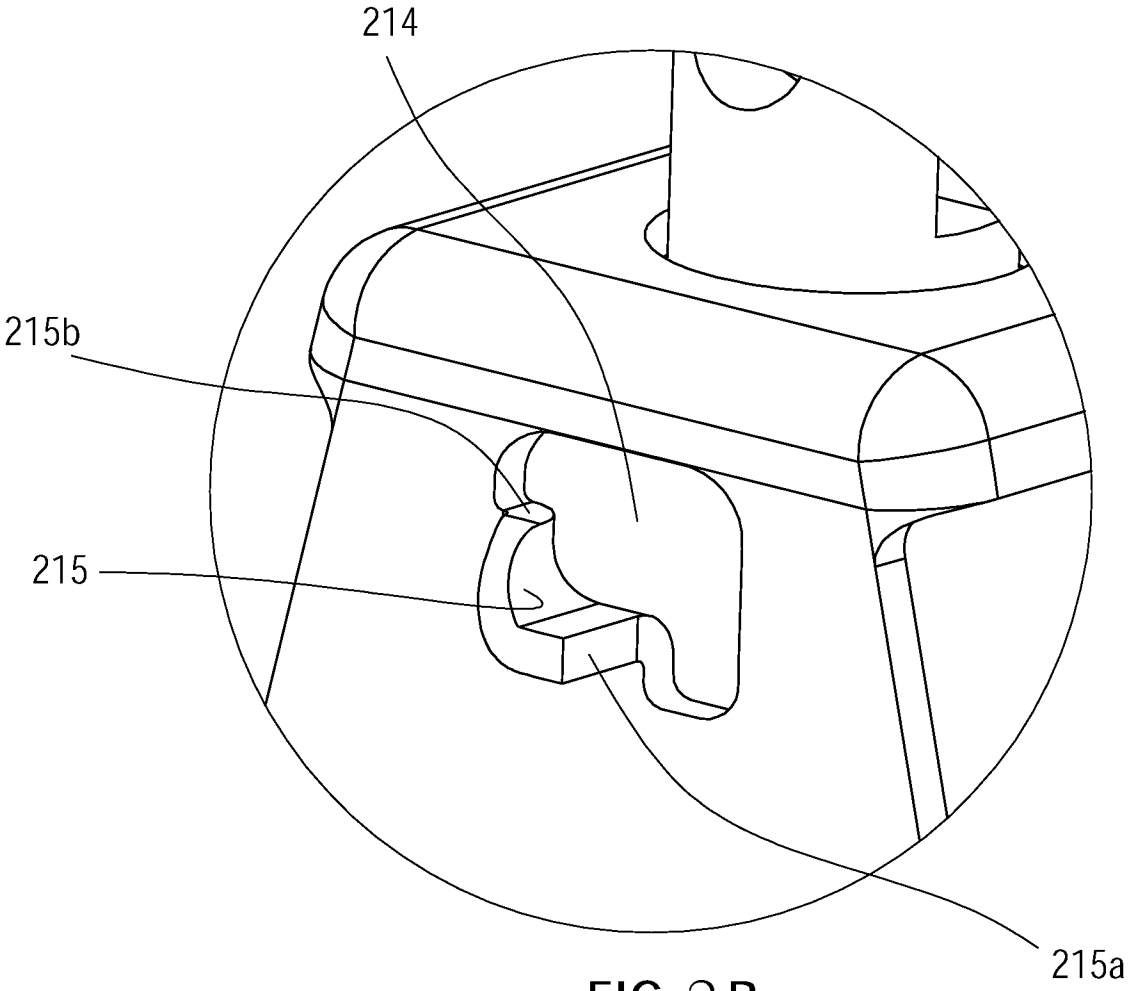
FIG. 2B is a partially enlarged view of FIG. 2A.
Figure 3:
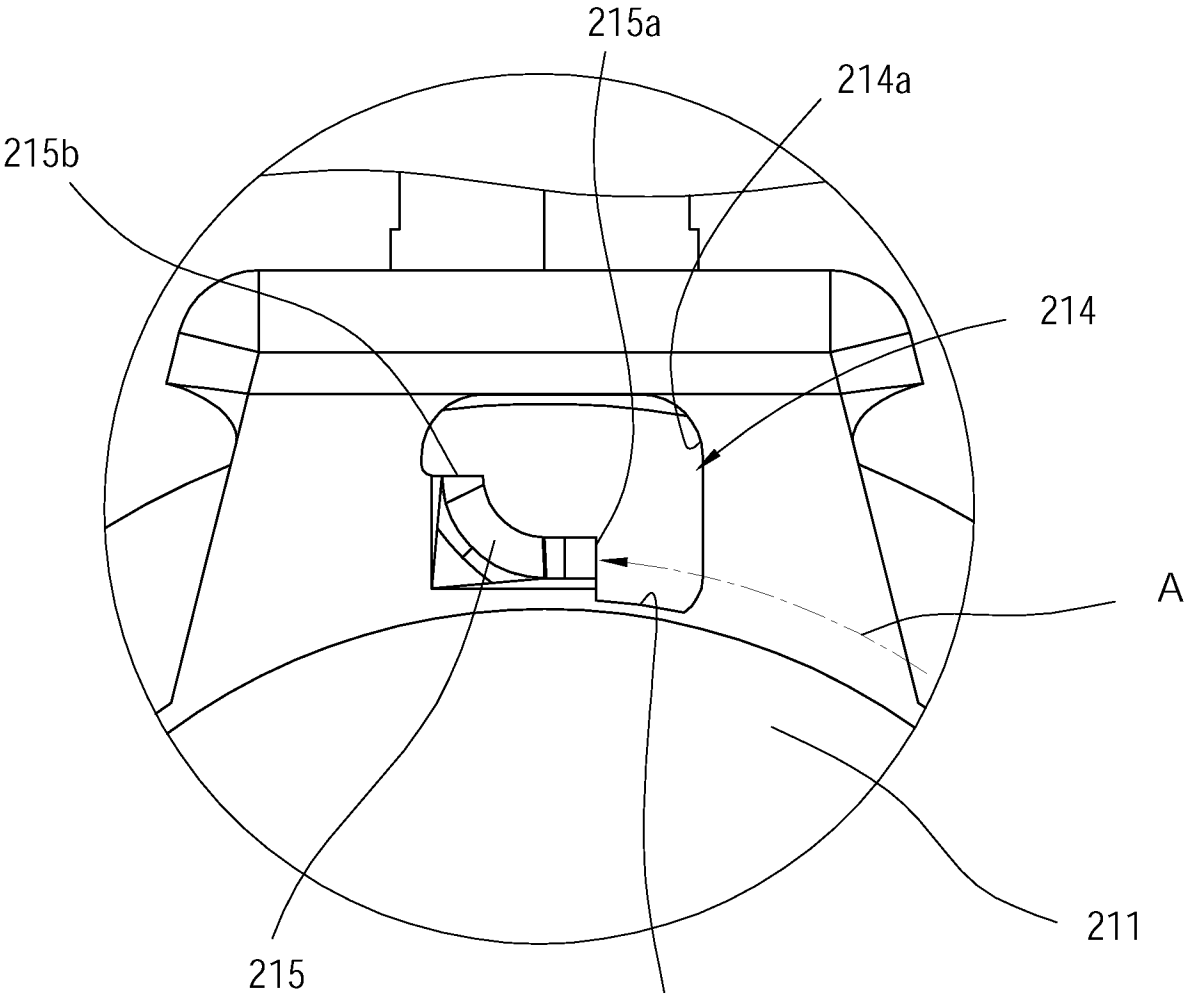
FIG. 3 is a partially enlarged view, showing partial components of FIG. 1.

As shown in FIG. 1 to FIG. 3, two casings 11 are engaged with each other to constitute the housing 10.

The frame 20 has a frame body 21 and a hanging ring 22. The frame body 21 has a first side plate 211, a second side plate 212, and a top plate 213, wherein the first side plate 211 is parallel to the second side plate 212 and is spaced from the second side plate 212 by a predetermined distance, and the top plate 213 is connected to both of a top end of the first side plate 211 and a top end of the second side plate 212. At least one hollow hole 214 is formed on an outer surface of the first side plate 211 (i.e., a lateral side of the frame 20). In the current embodiment, the outer surface of the first side plate 211 has two holes 214 thereon. A stopper 215 extends outward relative to the outer surface of the first side plate 211 from two adjacent side walls of the hole 214. In the current embodiment, the stopper 215 is curved and extends in an arc shape and is integrally connected to the two adjacent side walls of the hole 214 as a monolithic unit.

The first side plate 211 has a connecting hole 216 passing through a center thereof. The hanging ring 22 is engaged with the top plate 213 of the frame body 21. The frame body 21 is fixed on an inside of the housing 10. The hanging ring 22 extends out of the housing 10 from a top of the housing 10. In the current embodiment, the hole 214 includes a first portion 214*a* and a second portion 214*b*, wherein the first portion 214*a* communicates with the second portion 214*b*. The stopper 215 is connected to two side walls of the first portion 214*a* of the hole 214. The second portion 214*b* is closer to the connecting hole 216 than the first portion 214*a*.

More specifically, as shown in FIG. 2B and FIG. 3, the stopper 215 has a first side end 215*a* and a second side end 215*b* and extends in an arc shape from the first side end 215*a* toward the second side end 215*b*. A height of the stopper 215 relative to the outer surface of the first side plate 211 decreases gradually from the first side end 215*a* to the second side end 215*b*. In the current embodiment, the stopper 215 extends away from the braking plate in an arc-shape. In other words, a bending direction that the stopper 215 bends between the first side end 215*a* and the second side end 215*b* is opposite to an arc direction A, wherein the arc direction A is centered on the connecting hole 216, and the first side end 215*a* of the stopper 215 is located on the arc direction A. The second side ends 215*b* and the first side end 215*a* face in different directions.

As shown in FIG. 1 to FIG. 3, the rotatable member 30 is rotatably and pivotally disposed between the first side plate 211 and the second side plate 212 of the frame 20.

As shown in FIG. 1 to FIG. 3, the safety belt 40 winds around an outer peripheral surface of the rotatable member 30. An end of the safety belt 40 is fixed on the rotatable member 30, while another end thereof extends out of the housing 10 via a bottom of the housing 10, so that the safety belt 40 pulls the rotatable member 30 to rotate.

As shown in FIG. 1 to FIG. 3, the winding device 50 includes a boxing 51 and a spiral spring (not shown), wherein the boxing 51 is connected to an outer surface of the second side plate 212 of the frame 20 and is located inside of the housing 10. The spiral spring is disposed inside of the boxing 51, wherein an inner end of the spiral spring is connected to the rotatable member 30, and an outer end of the spiral spring is connected to the boxing 51, so that a rewinding force exerted on the rotatable member 30 is provided by the spiral spring of the winding device 50 to rewind the safety belt 40.

As shown in FIG. 1 to FIG. 3, the braking plate 60 has a plate body 61 and a driven shaft 62 protruding from a center of an inner surface of the plate body 61. The braking plate 60 is disposed inside of the housing 10 with the driven shaft 62 passing through the connecting hole 216 of the frame 20, so that the braking plate 60 is coaxially connected to the rotatable member 30, whereby the braking plate 60 rotates coaxially along with the rotatable member 30. The second portion 214*b* is closer to an outer edge of the plate body 61 than the first portion 214*a* of the hole 214.

Figure 4:
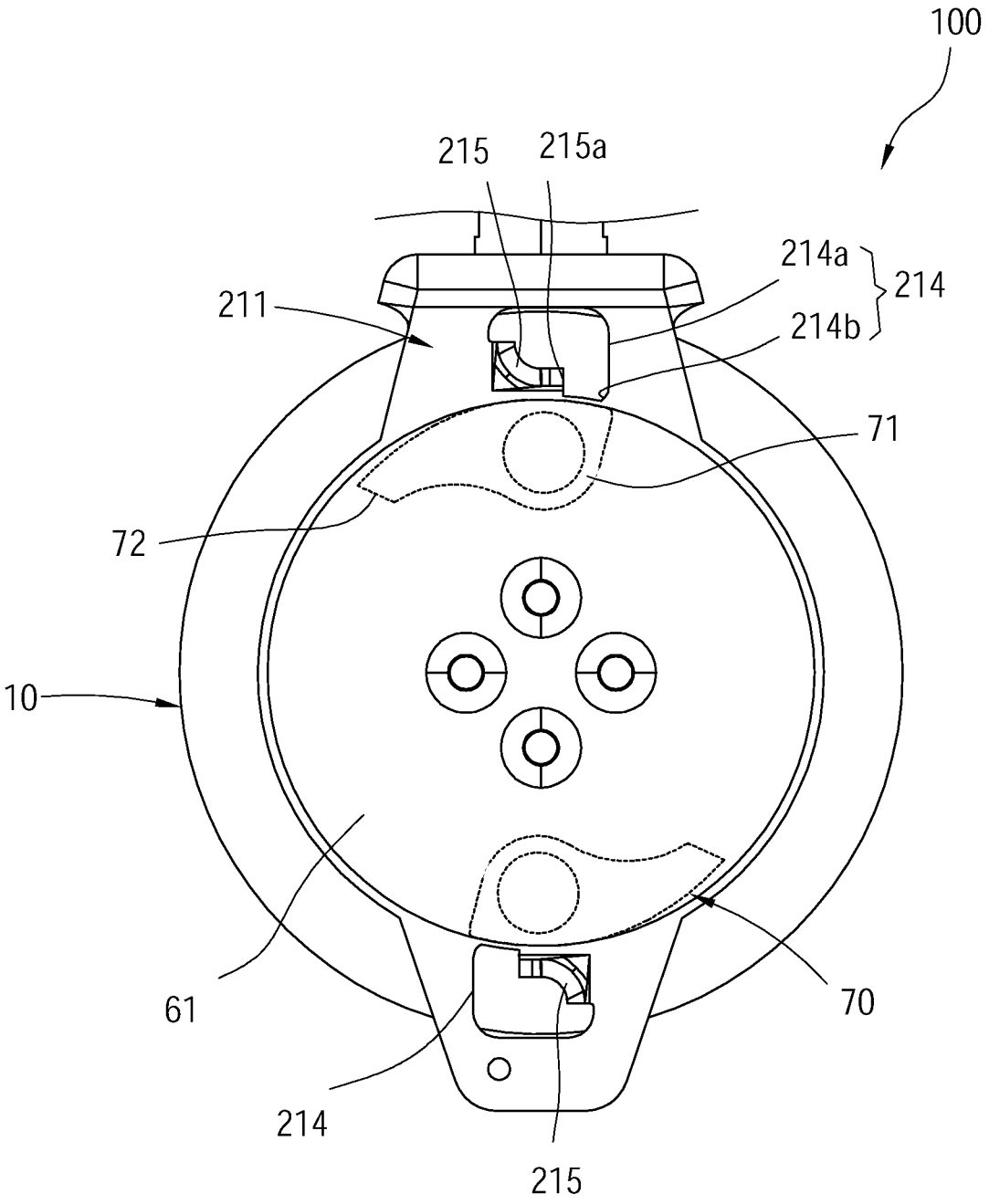
FIG. 4 is a schematic view, showing the braking parts are located at the restoring position.

As shown in FIG. 1 to FIG. 3, the at least one braking part 70 is integrally formed as a monolithic unit. In the current embodiment, the fall protection device 100 includes two braking parts 70. The braking part 70 has a body 71 and an abutting portion 72, wherein the body 71 is pivotally connected to the inner surface of the plate body 61 of the braking plate 60, and faces the outer surface of the first side plate 211 of the frame 20. The abutting portion 72 is located on an outer end of the body 71. The braking part 70 could pivot between a restoring position (as shown in FIG. 4) and a locking position (shown in FIG. 5). When the braking part 70 is pivoted and deployed to the locking position, the abutting portion 72 abuts against the first side end 215*a* of the stopper 215 in the arc direction A.

As shown in FIG. 2A, the restoring spring 80 is connected between a side of the abutting portion 72 of the braking part 70 and the plate body 61 of the braking plate 60 to provide an elastic force for moving the braking part 70 back to the restoring position. In this way, in a condition without being subjected to an external force, the elastic force could urge the braking part 70 to normally stay at the restoring position.

Figure 5:
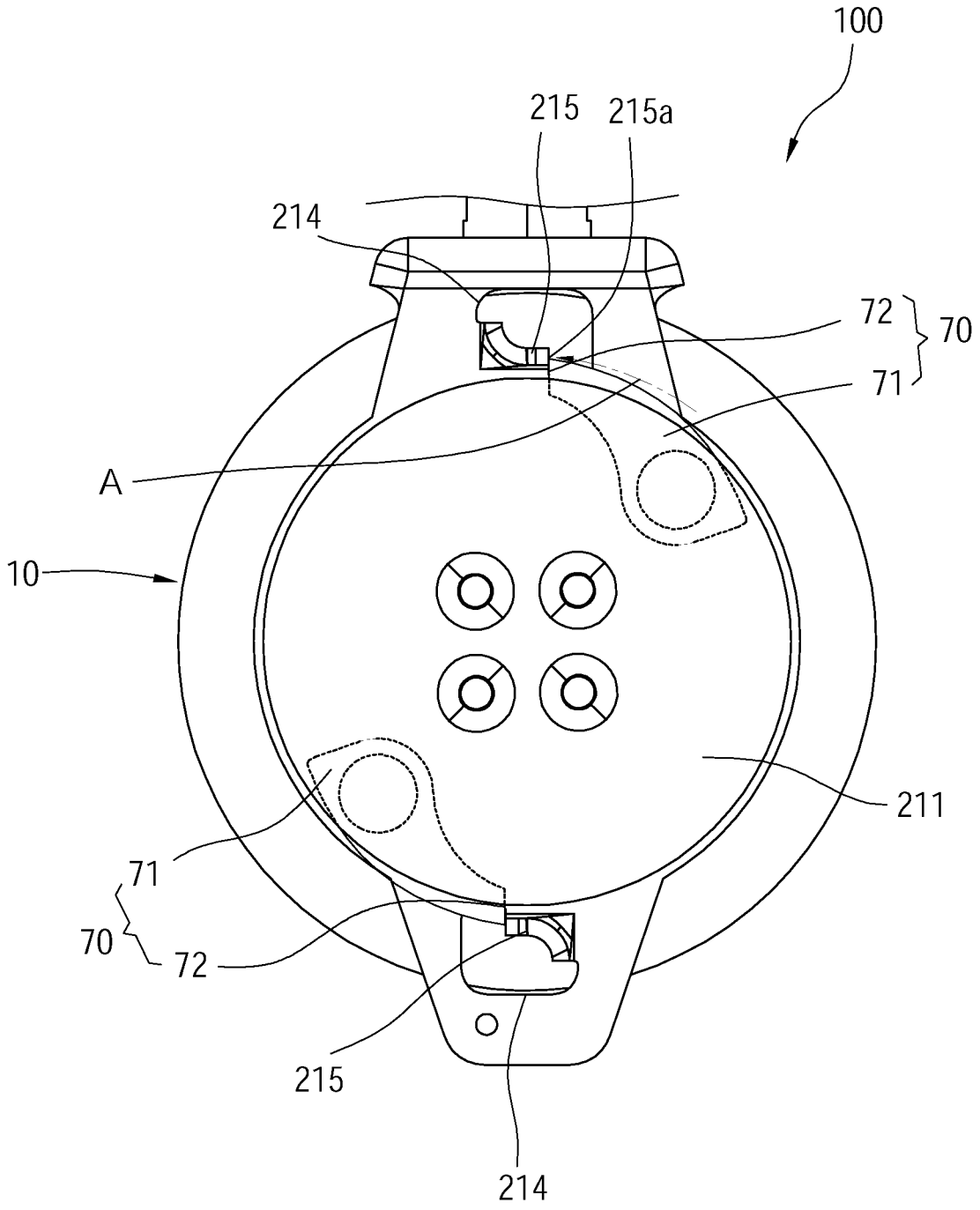
FIG. 5 is a schematic view, showing the braking parts are located at the locking position.

While using the fall protection device 100 of the present invention, the hanging ring 22 of the frame 20 is fixed on a secure support, and the safety belt 40 is fastened to an operator working in elevated workplaces. When the operator carelessly falls from an elevated site, the safety belt 40 would be pulled out for a short length and rotate the rotatable member 30 and the braking plate 60 rapidly, so that the braking part 70 is spun out to the locking position by a centrifugal force which is generated by the rapidly rotating braking plate 60 and overcomes the elastic force of the restoring spring 80. At this time, the abutting portion 72 of each of the braking parts 70 abuts against the stopper 215 of the frame 20, as shown in FIG. 5, thereby to stop the rotatable member 30 and the braking plate 60 from rotating, preventing the safety belt 40 from being pulled out again and preventing the operator from continuously falling.

In the current embodiment, the stopper 215 extends in an arc-shape, and the stopper 215 and the two adjacent side walls of the hole 214 is integrally connected as a monolithic unit. In this way, when the stopper 215 is bumped and is abutted by the braking part 70, the stress generated by a collision between the stopper 215 and the braking part 70 is gradually transmitted through the curved surface and is dissipated to the other end, whereby stress could be prevented from excessive concentration and retention. By connecting the stopper 215 and the two adjacent side walls of the hole 214, an engaging strength between the stopper 215 and the frame 20 could be strengthened, whereby to avoid cracking and fracturing. In this way, the stress could be dispersed, and the damage of the components could be reduced, thereby increasing the service life of the fall protection device 100. Since the bending direction of the stopper 215 is opposite to the arc direction A that the braking part 70 moves, the stress generated by the collision could be further dispersed. In addition, since the height of the stopper 215 relative to the outer surface of the first side plate 211 decreases gradually from the first side end 215*a* to the second side end 215*b*, the stopper 215 is allowed to withstand a large impact force at a portion closed to the first side end 215*a*, and the force received at a portion gradually away from the first side end 215*a* is gradually reduced. Therefore, the height reduced structure allows for less material use without compromising strength, which saves material cost.

It must be pointed out that the embodiments described above are only some preferred embodiments of the present invention. All equivalent structures which employ the concepts disclosed in this specification and the appended claims should fall within the scope of the present invention.

What is claimed is:

1. A fall protection device, comprising:

a frame having a side plate, wherein the side plate has an outer surface and an inner surface which face opposite directions, and at least one stopper protrudes outwardly from the outer surface of the side plate; the at least one stopper has a first side end and a second side end, and extends in an arc shape from the first side end toward the second side end;

a rotatable member, which is rotatably disposed on the frame;

a safety belt which winds around an outer peripheral surface of the rotatable member and pulls the rotatable member to rotate;

a braking plate which is coaxially connected to the rotatable member, whereby the braking plate rotates coaxially along with the rotatable member; and at least one braking part which is pivotally connected to the braking plate and faces the outer surface of the side plate of the frame, wherein when the braking plate rotates, the at least one braking part is driven to pivot from a restoring position to a locking position to abut against the first side end of the at least one stopper, thereby to restrict the rotatable member from rotating;

wherein the inner surface of the side plate faces the safety belt;

wherein the at least one stopper protrudes away from the rotatable member and protrudes in a direction from the inner surface of the side plate to the outer surface of the side plate;

wherein a height of the at least one stopper relative to the outer surface of the side plate decreases gradually from the first side end to the second side end.

2. The fall protection device of claim 1, wherein the at least one stopper is arc-shaped and curves away from the braking plate.

3. The fall protection device of claim 1, wherein the at least one braking part has a body and an abutting portion integrally connected to the body as a monolithic unit; the body is pivotally connected to the braking plate; when the at least one braking part pivots to the locking position, the abutting portion abuts against the at least one stopper.

4. The fall protection device of claim 1, wherein at least one hole is formed on the side plate of the frame; the at least one stopper is connected to two adjacent side walls of the at least one hole.

5. The fall protection device of claim 4, wherein the at least one hole comprises a first portion and a second portion; the first portion communicates with the second portion; the at least one stopper is connected to two side walls of the first portion of the at least one hole; the second portion is closer to the braking plate than the first portion.

6. A fall protection device, comprising:

a frame having a side plate, wherein the side plate has an outer surface and an inner surface which face opposite directions, and at least one stopper protrudes outwardly from the outer surface of the side plate; the at least one stopper has a first side end and a second side end, and extends in an arc shape from the first side end toward the second side end;

a rotatable member, which is rotatably disposed on the frame;

a safety belt which winds around an outer peripheral surface of the rotatable member and pulls the rotatable member to rotate;

a braking plate which is coaxially connected to the rotatable member, whereby the braking plate rotates coaxially along with the rotatable member; and at least one braking part which is pivotally connected to the braking plate and faces the outer surface of the side plate of the frame, wherein when the braking plate rotates, the at least one braking part is driven to pivot from a restoring position to a locking position to abut against the first side end of the at least one stopper, thereby to restrict the rotatable member from rotating;

wherein the inner surface of the side plate faces the safety belt;

wherein the at least one stopper protrudes away from the rotatable member and protrudes in a direction from the inner surface of the side plate to the outer surface of the side plate;

wherein the at least one stopper is arc-shaped and curves away from the braking plate.

7. The fall protection device of claim 6, wherein the at least one braking part has a body and an abutting portion integrally connected to the body as a monolithic unit; the body is pivotally connected to the braking plate; when the at least one braking part pivots to the locking position, the abutting portion abuts against the at least one stopper.

8. The fall protection device of claim 6, wherein at least one hole is formed on the side plate of the frame; the at least one stopper is connected to two adjacent side walls of the at least one hole.

9. The fall protection device of claim 8, wherein the at least one hole comprises a first portion and a second portion; the first portion communicates with the second portion; the at least one stopper is connected to two side walls of the first portion of the at least one hole; the second portion is closer to the braking plate than the first portion.

10. A fall protection device, comprising:

a frame having a side plate, wherein the side plate has an outer surface and an inner surface which face opposite directions, and at least one stopper protrudes outwardly from the outer surface of the side plate; the at least one stopper has a first side end and a second side end, and extends in an arc shape from the first side end toward the second side end;

a rotatable member, which is rotatably disposed on the frame;

a safety belt which winds around an outer peripheral surface of the rotatable member and pulls the rotatable member to rotate;

a braking plate which is coaxially connected to the rotatable member, whereby the braking plate rotates coaxially along with the rotatable member; and at least one braking part which is pivotally connected to the braking plate and faces the outer surface of the side plate of the frame, wherein when the braking plate rotates, the at least one braking part is driven to pivot from a restoring position to a locking position to abut against the first side end of the at least one stopper, thereby to restrict the rotatable member from rotating;

wherein the inner surface of the side plate faces the safety belt;

wherein the at least one stopper protrudes away from the rotatable member and protrudes in a direction from the inner surface of the side plate to the outer surface of the side plate;

wherein at least one hole is formed on the side plate of the frame; the at least one stopper is connected to two adjacent side walls of the at least one hole.

11. The fall protection device of claim 10, wherein the at least one braking part has a body and an abutting portion integrally connected to the body as a monolithic unit; the body is pivotally connected to the braking plate; when the at least one braking part pivots to the locking position, the abutting portion abuts against the at least one stopper.

12. The fall protection device of claim 10, wherein the at least one hole comprises a first portion and a second portion; the first portion communicates with the second portion; the at least one stopper is connected to two side walls of the first portion of the at least one hole; the second portion is closer to the braking plate than the first portion.

* * * * *